US005575137A

United States Patent [19]

Metz et al.

[11] Patent Number: 5,575,137

[45] Date of Patent: Nov. 19, 1996

[54] CROSS-SEALING DEVICE FOR A TUBULAR BAG PACKAGING MACHINE

[75] Inventors: Hartmut Metz, Nieder-Ohmen; Dieter Korzer, Wetzlar; Walter Baur, Gruendau, all of Germany

[73] Assignee: Rovema Verpackungsmaschinen GmbH, Fernwald, Germany

[21] Appl. No.: 420,870

[22] Filed: Apr. 12, 1995

[30] Foreign Application Priority Data

Apr. 13, 1994 [DE] Germany ..... 44 12 577.1

[51] Int. Cl.[6] ..... B65B 9/12; B65B 9/20; B65B 51/26; B65B 61/00

[52] U.S. Cl. ..... 53/552; 53/551; 53/554

[58] Field of Search ..... 53/551, 552, 554, 53/451, 373.7

[56] References Cited

U.S. PATENT DOCUMENTS

| | | | |
|---|---|---|---|
| 2,915,866 | 12/1959 | Bartlo | 53/552 X |
| 2,956,383 | 10/1960 | Gausman | 53/552 X |
| 2,962,843 | 12/1960 | Hoelzer et al. | 53/551 X |
| 3,070,931 | 1/1963 | Zwight | 53/552 |
| 3,307,323 | 3/1967 | Fener | 53/551 |
| 4,450,669 | 5/1984 | Rapparini | 53/551 |
| 4,563,862 | 1/1986 | McElvy | 53/552 |
| 4,947,618 | 8/1990 | Schneider et al. | 53/552 X |
| 5,203,145 | 4/1993 | Kammler et al. | 53/552 |
| 5,279,098 | 1/1994 | Fukuda | 53/551 X |
| 5,454,208 | 10/1995 | Kawano | 53/551 X |

FOREIGN PATENT DOCUMENTS 2732033 4/1989 Germany .

*Primary Examiner*—Horace M. Culver

*Attorney, Agent, or Firm*—Flynn, Thiel, Boutell & Tanis, P.C.

[57] ABSTRACT

A cross-sealing device for a tubular-bag packaging machine operable with stripping rods moved along the plastic foil tube to be sealed, which stripping rods assure that the sealing surfaces are free of packaging material prior to the sealing task. A drive is provided for the stripping rods which is mechanically robust and makes it possible to adapt the stripping paths on the plastic foil tube to the special requirements. Belt drives are provided for this purpose which are driven independently of the cross-sealing jaws and are controlled by a position controller controlling the position of the stripping rods.

16 Claims, 3 Drawing Sheets

CROSS-SEALING DEVICE FOR A TUBULAR BAG PACKAGING MACHINE

FIELD OF THE INVENTION

The invention relates to a cross-sealing device for a tubular foil bag packaging machine which includes at least one pair of cross-sealing jaws which can be placed against a plastic foil tube and moved therealong, if necessary, in a direction parallel to a longitudinal axis, the jaws effecting a dividing of the tube transversely with respect to its longitudinal axis by a cross-sealing seam into individual tubular bag packages, and further including at least one pair of stripping rods running ahead of the cross-sealing jaws and arranged symmetrically to one another and extending parallel with respect to the cross-sealing seam, and moved symmetrically toward one another and along the sealing area, which stripping rods wipe within and along at least one portion of the sealing area to clamp the plastic tube therebetween, at least over an area of the plastic tube provided for the cross-sealing seam in such a manner that the packaging material is wiped away from this area into the tubular bag package to be closed.

BACKGROUND OF THE INVENTION

A cross-sealing device of this type is already known from the German Offenlegungsschrift DE 37 32 033 A1 (corresponding to U.S. Pat. No. 4,947,618). It assures that the area of the later cross-sealing seam is kept free of packaging material until after the sealing takes place. The movement of the stripping rods is thereby coupled to the movement of the cross-sealing jaws in order to avoid defective tries with such a forced guiding. Namely it must be assured that the stripping rods are already below the cross-sealing jaws when the jaws produce the sealing seam, and they must move faster along the sealing area than the plastic tube in order to move the packaging material possibly existing in the area of the later occurring sealing seam toward the earlier formed seal, namely, the actual packaging volume. The stripping rods are for this purpose tied to the cross-sealing jaws by means of pivotally supported levers and are, just like the cross-sealing jaws, guided by a cam control. The arrangement requires a significant mechanical structure and is subjected to a great wear because of the high productivity of such a cross-sealing device used in high-performance tubular bag packaging machines. As a rule, it is a one-purpose device which can be adapted only with great difficulties to different packaging parameters.

The purpose of the invention is therefore to provide a cross-sealing device of the type identified in detail above in such a manner that highly sensitive and expensive mechanical forced guideways for the stripping rods are no longer needed and the structural parts therefor are wear-resistant. The structural parts can be easily replaced without any complicated mounting operations, and a user-friendly simple adapting of the system to different packaging tasks can easily be carried out.

SUMMARY OF THE INVENTION

The purpose is attained according to the invention by providing on both sides of and symmetrically with respect to the sealing area an endless, flexible driving belt, by fastening the stripping rods in pairs on the two driving belts, by furthermore synchronously driving the driving belts by a common drive over a driving roller, and by furthermore providing a control device for this drive, which control device controls the movement of the stripping rods independently from the movements of the plastic foil tube and of the cross-sealing jaws, with the driving belts being each formed by an endless closed toothed belt.

A fixed mechanical association of the movement of the stripping rods with those of the cross-sealing jaws is no longer necessary in the cross-sealing device of the invention. The instead provided belt drive has the advantage that the structural elements, which are being used, are not subjected to a constant mechanical wear and do not require any expensive special manufacture, but can be composed of commercially available parts and can be easily renewed by replacing these parts. The special control of the stripping rods permits an adaptation of the cross-sealing device to many different packaging tasks, whereby, for example, the respective packaging material and the type and size of the plastic foil tube and of the tubular foil bag packages can be taken into consideration.

An arrangement of the driving belt spacially adapted to the movement of the stripping rods is created when the preferably spur-toothed inside of the driving belt is guided over each one of the driving rollers and several first tensioning rollers, with the driving roller being advantageously provided at the end of the sealing area so that the stripping rods are always on the slackened segment or strand of the driving belt when they wipe over the plastic foil tube.

The driving belts, which with reference to the sealing area are spacially symmetrically arranged, can be easily synchronously driven in such a manner that the moment of torque is introduced into the driving rollers by means of a common belt drive connected to the drive, whereby it is advantageous when the slip of the belt drive on the driving rollers is minimized by at least one second tensioning roller in the best way so that the second tensioning roller(s) is (are) arranged in such a manner that the belt tension or looping angle of the belt around the two driving rollers is almost the same.

It is particularly advantageous when a servomotor is provided for the drive, which servomotor is speed-controlled by a position-controlling means controlling the time-dependent position of the stripping rods, which position can be measured in a simple manner by a proximity switch. Such position controls can be carried out very exactly and inertialess primarily with electronic measuring and controlling means so that the functional separation of the drives of the cross-sealing jaws and stripping rods does not have any disadvantageous consequences caused by their spacial association.

A significant improvement in the state of the art is also the possibility, created by the invention, to change the desired characteristics of such a position control, for which purpose it is advantageous when the position-controlling means has an incremental transmitter for effecting a speed control of the servomotor. An adjustment can occur user-friendly when a display is provided on the position-controlling means as the desired-value adjustment for determining the stripping path covered within the sealing area by the stripping rods clamping the plastic foil tube and moving the packing material into the tubular foil bag package.

It is as a rule advantageous when the sealing area is arranged vertically, because the packaging material is thereby subjected to the force of gravity and cannot by itself move back into the area of the sealing seam when it has already been wiped away therefrom.

With the help of the display, it is possible to adjust an upper stripping-path section, which ends closely below the cross-sealing jaws resting on the cross-sealing seam, however, it is instead or in addition also possible that a lower stripping path section can be adjusted which starts only closely below the cross-sealing jaws resting on the cross-sealing seam. Both stripping-path sections form together the stripping path, which can be modified in this manner.

A correct stripping of the plastic foil tube can be guaranteed when the respective driving belt is guided within the sealing area at least partially on its side not facing the tubular foil bag package each by a stationary bearing piece in such a manner that the driving belt maintains its position even when the stripping rods resting on the plastic foil tube apply a torque to the driving belt. Such a spacially fixed arrangement is substantially less susceptible to breakdown and subjected to wear compared with continuously moved lever systems, as they must exist in the devices known from the state of the art for transmitting the necessary stripping forces.

BRIEF DESCRIPTION OF THE DRAWINGS

The invention will be discussed in greater detail hereinafter in connection with one exemplary embodiment and the drawings, in which.

DETAILED DESCRIPTION

Figure 1:
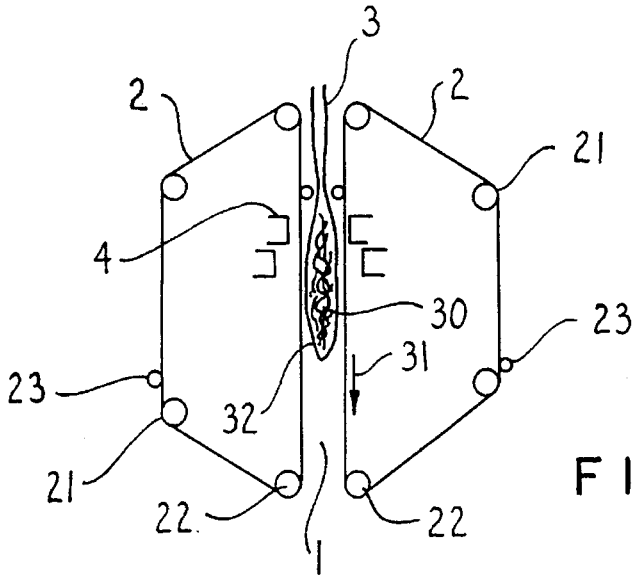
FIG. 1 illustrates the mechanical principle of a cross-sealing device embodying the invention.
Figure 4:
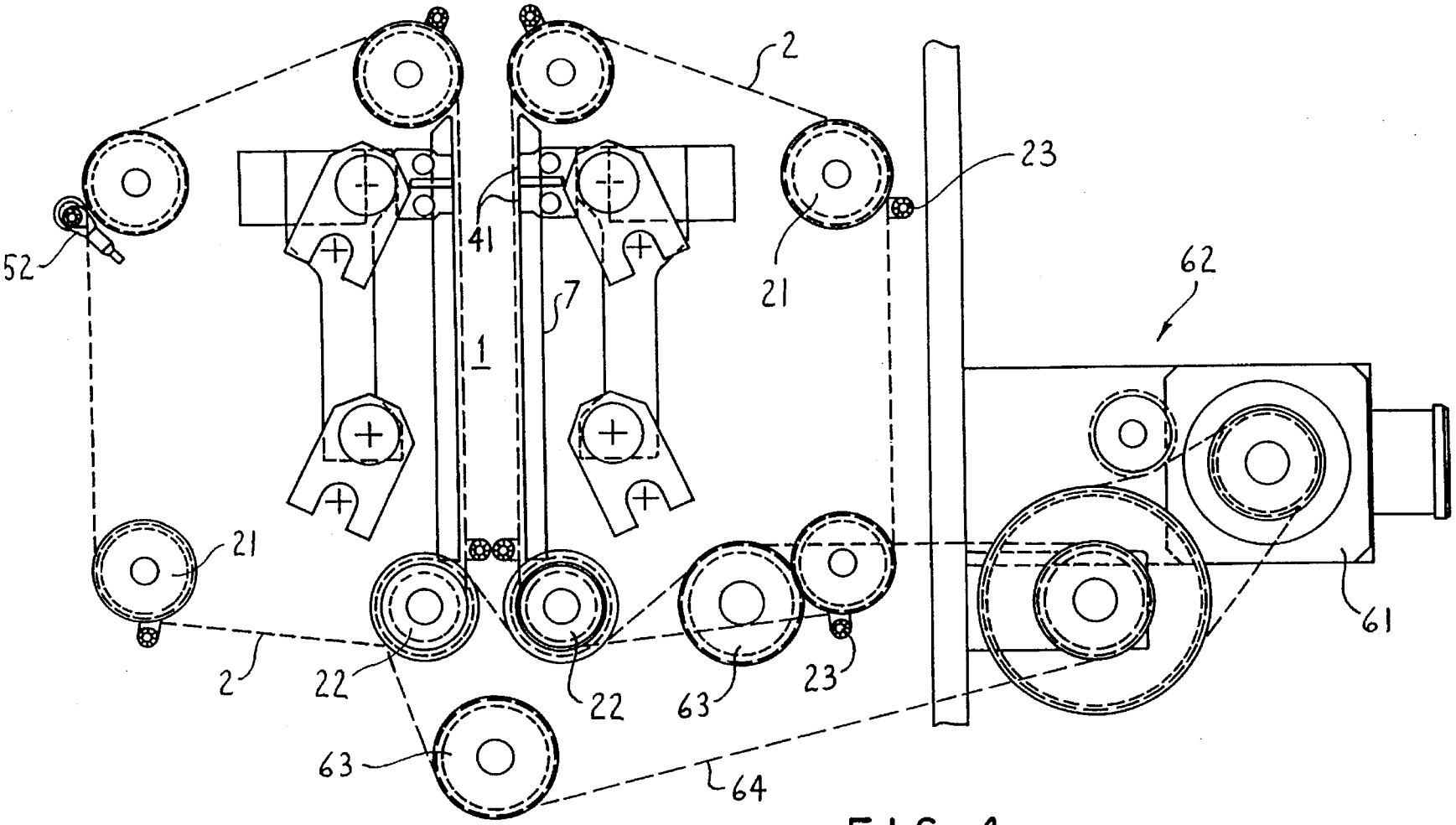
FIG. 4 illustrates an advantageous structural arrangement embodying the invention, all in a schematically simplified diagram.

A cross-sealing device of the invention consists, in accordance with FIGS. 1 and 4, of two elastic and endless driving belts 2, which are mirror-symmetrically arranged on opposite sides of a rectilinearly extending sealing area 1. The two driving belts are each guided over associated first tensioning rollers 21, and (FIG. 4) each are driven by one driving roller 22. A plastic thin wall foil tube 3 is moved in the direction indicated by the arrow 31 vertically downwardly through the sealing area 1, whereby packaging material 30 is introduced into the plastic foil tube 3 in a conventional manner not shown in detail in the drawing.

Two cross-sealing jaws 4, which can be moved toward one another, are indicated in FIG. 1, which cross-sealing jaws are shown in slightly greater detail in FIG. 4. The cross-sealing jaws 4 are each provided with two sealing surfaces 41 which produce two parallel cross-sealing seams on the compressed plastic foil tube 3. A cutting device is provided between the sealing surfaces 41, which cutting device for reasons of clarity is not shown in the drawing and is used to separate the tubular bag packages 32 from the plastic tube 3. These details are well known and, therefore, are not shown or described. The cross-sealing jaws 4 are synchronized with one another, however, are driven independently from the driving belts 2 and rest only within the sealing area 1 and at intermittent times on the plastic tube 3 for the purpose of sealing and separating the tubular bag packages 32 from the tube 3. This is schematically indicated in FIG. 1 by a dotted illustration of the cross-sealing jaws 4, which have already again been removed from the area of the plastic tube 3. The manner by which the cross-sealing jaws 4 are driven is not related to the invention; an example can be taken from the above-identified reference.

A plurality of pairs of stripping rods 23 are fastened to the driving belts 2 in such a manner that the mirror symmetry of the driving belts 2 is maintained. Two pairs of stripping belts 23 can be recognized in FIG. 1 and four pairs in FIG. 4, indicating in this manner that the paired number of stripping rods 23 is relatively variable and can be adapted to the respective packaging tasks. The shorter the tubular bag packages 32, the more pairs of stripping rods 32 must be used.

Figure 2:
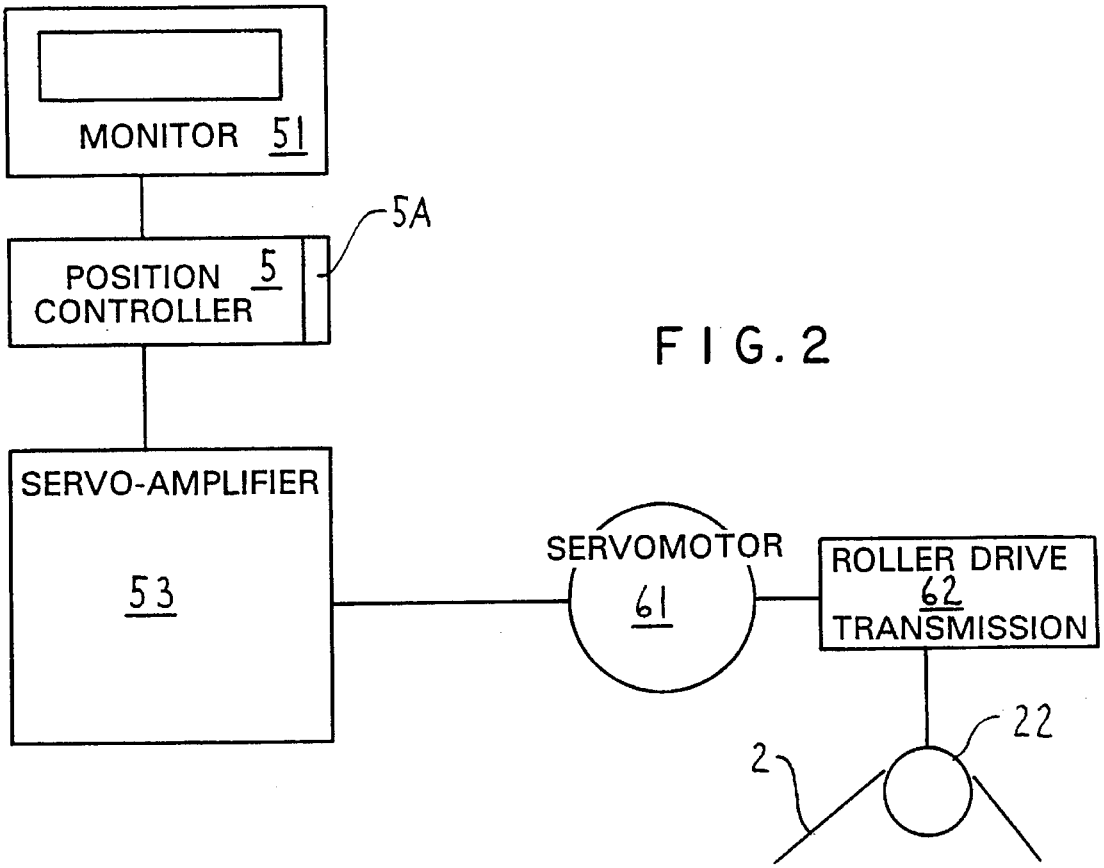
FIG. 2 illustrates the technical control operating principle of a cross-sealing device embodying the invention.

According to FIG. 2, a position-controlling means 5 is used as the central control system for controlling the driving belts 2 of the cross-sealing device of the invention, which position-controlling means 5 controls the operation of the driving belts 2 in dependency of a desired-value adjustment parameter, which can be presented on a display 51, and in dependency of the actual value for the position of the stripping rods 23, which is determined by a proximity switch 52 (FIG. 4). The input variables obtained in this manner are processed electronically in a known and suitable manner; the output variables depending thereon for controlling the position, speed and acceleration of the stripping rods 23 are, reinforced in a servoamplifier 53, fed to a servomotor 61 which drives the driving rollers 22 through a gearing 62 (FIG. 4). In place of a position control, it is also possible to carry out a position regulation when the position-controlling means 5 is equipped with an incremental transmitter for effecting an altering of the speed of the servomotor 61.

Figure 3A:
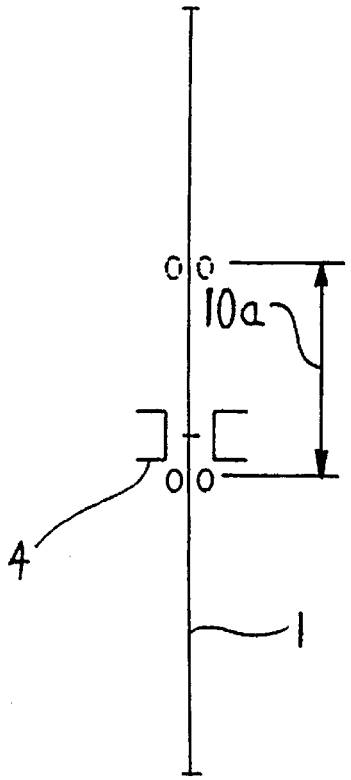
FIGS. 3*a* and 3*b* each illustrate partial segments of a stripping path.
Figure 3B:
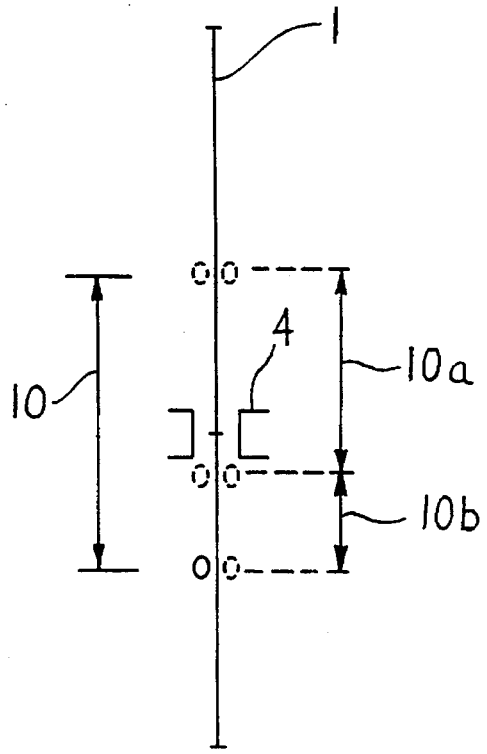

By using the display 51, it is possible to modify and divide a stripping path 10 (FIG. 3*b*). The stripping path 10 is thereby the stretch within the sealing area 1 which is necessary for a complete removal of the packaging material 30 from the area of the plastic tube 3, which area is provided for the sealing task, and within which area the stripping rods 32 are moved along the slower moving plastic tube 3 clamping the said tube therebetween. FIG. 3*a* shows that it is thereby possible to adjust an "upper" stripping-path section 10*a*, which ends shortly below the position where the cross-sealing jaws 4 move to during the creation of the cross-sealing seam. Whereas a "lower" stripping-path section 10*b* (FIG. 3*b*) starts at this point and extends in direction of the arrow 31. The entire stripping path 10, just like the stripping-path sections 10*a* and 10*b*, can be changed within device-fixed boundary values.

A drive 6, which consists essentially of the servomotor 61 and the gearing 62, drives the driving rollers 22. It includes, according to FIG. 4, a drive belt 64 engaged by second tensioning rollers 63 making sure that a sufficient belt tension exists in the area where the belt 64 engages driving rollers 22 to guarantee that the belts do not slip to alter the synchronous drive of the belts 2.

Each drive belt 2 is backed or supported by a stationary bearing piece 7 located in the cross-sealing device, particularly under the slackened portion of the strand of the respective driving belt 2 immediately preceding the belts' movement into engagement with the driving rollers 22 so that same cannot yield when the stripping rods 23 operatively engage the plastic tube 3.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a cross-sealing device for a tubular foil bag packaging machine including at least one pair of cross-sealing jaws, a first support means for movably mounting said cross sealing jaws on said tubular foil bag packaging machine whereby said cross sealing jaws move into and out of engagement with a plastic foil tube, at least one pair of stripping rods, and a second support means for symmetrically moving said at least one pair of stripping rods and mounting said at least one pair of stripping rods on said tubular foil bag packaging machine, said at least one pair of cross-sealing jaws being movable into and out of engagement with the plastic foil tube in a direction perpendicular to a longitudinal axis of the plastic foil tube to thereby divide transversely with respect to its longitudinal axis through a cross-sealing seam the plastic foil tube into individual tubular bag packages, said at least one pair of stripping rods being arranged on said second support means symmetrically to one another and parallel with respect to the cross-sealing seam and being symmetrically movable toward one another along an area to be sealed causing said at least one pair of stripping rods to wipe within and along at least one portion of the plastic foil tube in said area to be sealed clamping the plastic foil tube therebetween at least over an area of the plastic foil tube whereat the cross-sealing seam is to be formed so that the packaging material is wiped away from said area to be sealed into the tubular bag package to be closed prior to operation of said at least one pair of cross sealing jaws, the improvement wherein an endless and elastically yieldable and flexible driving belt is provided on opposite sides of and symmetrically with respect to said area to be sealed; wherein said second support means further includes a fastening means for attaching said at least one pair of stripping rods on said driving belts; wherein said driving belts are each synchronously driven by a common drive over a respective driving roller, and wherein a control device is provided for said common drive for controlling movement of said at least one pair of stripping rods independently of the plastic foil tube and of said at least one pair of cross-sealing jaws.

2. The cross-sealing device according to claim 1, wherein said driving belts are each formed by an endless toothed belt.

3. The cross-sealing device according to claim 2, wherein each toothed belt has spur-teeth on an inside surface thereof which are guided over said respective driving roller and several first tensioning rollers.

4. The cross-sealing device according to claim 1, wherein said respective driving roller is provided at a terminal end of said area to be sealed.

5. The cross-sealing device according to claim 1, wherein a motive force is introduced into each said respective driving roller by means of a common belt drive connected to said common drive.

6. The cross-sealing device according to claim 5, wherein at least one second tensioning roller is provided to minimize slippage of said driving belts.

7. The cross-sealing device according to claim 6, wherein at least one second tensioning roller is arranged in such a manner that the belt tension at both of said respective driving roller is almost the same.

8. The cross-sealing device according to claim 1, wherein said common drive includes a servomotor and a position-controlling means for controlling a time-dependent position of said at least one pair of stripping rods.

9. The cross-sealing device according to claim 8, wherein a proximity switch detects a position of said at least one pair of stripping rods.

10. The cross-sealing device according to claim 9, wherein said position-controlling means switches said servomotor through a servoamplifier.

11. The cross-sealing device according to claim 8, wherein said position-controlling means includes an incremental transmitter for controlling the speed of said servomotor.

12. The cross-sealing device according to claim 8, wherein a display is provided on said position-controlling means to indicate a desired-value adjustment for determining a stripping path covered within said sealing area by said at least one pair of stripping rods which clamp the plastic foil tube and move the packing material into the tubular bag package.

13. The cross-sealing device according to claim 1, wherein said sealing area is vertically arranged.

14. The cross-sealing device according to claim 13, wherein an upper stripping-path section, terminating closely below said at least one pair of cross-sealing jaws resting on the cross-sealing seam, is adjustable.

15. The cross-sealing device according to claim 13, wherein a lower stripping-path section, which starts closely below said at least one pair of cross-sealing jaws resting on the cross-sealing seam, is adjustable.

16. The cross-sealing device according to claim 1, wherein each paid respective driving belt is guided within said area to be sealed at least partially on a side thereof remote from the tubular bag package by a stationary bearing piece in such a manner that said driving belt maintains its position even when said at least one pair of stripping rod rest on the plastic foil tube to apply a torque to said driving belt.

* * * * *